US007438051B2

(12) United States Patent
Wachtendorf et al.

(10) Patent No.: US 7,438,051 B2
(45) Date of Patent: Oct. 21, 2008

(54) METHOD AND DEVICE FOR SUPPLYING INTERNAL COMBUSTION ENGINES WITH FUEL

(75) Inventors: Axel Wachtendorf, Klein Denkte (DE); Leonhard Lang, Braunschweig (DE); Nicola Piantadosi, Wolfsburg (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 11/766,841

(22) Filed: Jun. 22, 2007

(65) Prior Publication Data

US 2008/0072880 A1 Mar. 27, 2008

Related U.S. Application Data

(63) Continuation of application No. PCT/EP2005/012575, filed on Nov. 24, 2005.

(30) Foreign Application Priority Data

Dec. 24, 2004 (DE) ..... 10 2004 062 613

(51) Int. Cl.
*F02M 37/04* (2006.01)

(52) U.S. Cl. ..... 123/446; 123/516

(58) Field of Classification Search ..... 123/446, 123/447, 516, 514, 456, 179.17
See application file for complete search history.

(56) References Cited

U.S. PATENT DOCUMENTS

| | | | | |
|---|---|---|---|---|
| 6,253,734 | B1 * | 7/2001 | Rembold et al. | 123/446 |
| 6,708,671 | B1 | 3/2004 | Joos et al. | 123/464 |
| 6,889,656 | B1 * | 5/2005 | Rembold et al. | 123/446 |
| 2002/0092503 | A1 * | 7/2002 | Ricco | 123/446 |
| 2002/0092505 | A1 * | 7/2002 | Rembold et al. | 123/464 |
| 2003/0089339 | A1 * | 5/2003 | Schueler | 123/446 |
| 2004/0211395 | A1 * | 10/2004 | Greco et al. | 123/497 |
| 2006/0225706 | A1 | 10/2006 | Eser et al. | 123/457 |

FOREIGN PATENT DOCUMENTS

| | | |
|---|---|---|
| DE | 19951410 | 10/1999 |
| DE | 10137315 | 7/2001 |
| DE | 10158950 | 12/2001 |
| DE | 10300929 | 1/2003 |
| WO | 2006072285 | 7/2006 |

* cited by examiner

*Primary Examiner*—Carl S Miller
(74) *Attorney, Agent, or Firm*—Baker Botts L.L.P.

(57) ABSTRACT

A method and a device for supplying fuel to internal combustion engines comprise a regulated high-pressure system and a controlled low-pressure system, wherein an adaptation value for correcting the desired preliminary pressure is detected in an adaptation mode, in order to adjust a variable preliminary pressure in the low-pressure system. For this purpose, the preliminary pressure is specifically changed in the adaptation mode until vapor bubbles are detected by a regulator response of the high-pressure regulator of the high-pressure system. When vapor bubbles are detected, current process parameters of the fuel supply system are determined and the adaptation value is derived therefrom.

22 Claims, 4 Drawing Sheets

METHOD AND DEVICE FOR SUPPLYING INTERNAL COMBUSTION ENGINES WITH FUEL

CROSS-REFERENCE TO RELATED APPLICATIONS

This application is a continuation application of International Application No. PCT/EP2005/012575 filed Nov. 24, 2005, which designates the United States of America, and claims priority to German application number DE 10 2004 062 613.8 filed Dec. 24, 2004, the contents of which are hereby incorporated by reference in their entirety.

TECHNICAL FIELD

The invention relates to a method and a device for supplying fuel to internal combustion engines having an injection system by means of a high-pressure pump, particularly for supplying fuel to common rail systems, in which a pre-supply pump supplies fuel to the high-pressure pump.

BACKGROUND

Methods have been disclosed in the prior art to increase the fuel injection pressure in such a way for improving the performance of internal combustion engines having a cylinder injection system and for improving the reduction of exhaust gas that the fuel is atomized into small droplets. The fuel supply system of internal combustion engines is therefore designed so as to achieve the typical values for current systems for a high pressure of 4 to 10 Mpa.

Fuel supply systems disclosed in the prior art, such as the one described, for example, in DE 41 26 640 A1, are divided into a low-pressure system and a high-pressure system. The fuel, which is pre-supplied from the fuel tank by means of a low-pressure fuel pump and is under a low preliminary pressure, is delivered to the high-pressure pump, which is designed as a radial piston pump. The fuel pressure is raised further to a predetermined pressure value. The system pressure is regulated in the high-pressure system, wherein the actual pressure is detected using a high-pressure sensor, and compared with a desired pressure in an engine control unit, and a control value for a pressure-limiting valve is determined. The required pressure is adjusted in a high-pressure common rail and the excess fuel quantity is throttled off by way of a return flow line to the tank. The high pressure is regulated to the high-pressure desired value independently of the fuel quantity injected into the internal combustion engine. The excess fuel quantity can also be guided in a targeted manner in an additional rinse flow. However, this poses the problem of the fuel getting heated excessively.

According to DE 196 52 831 A1, instead of being led back to the tank, the fuel can also be guided back to the high-pressure pump and again compressed there immediately, thereby improving the efficiency of the fuel supply system.

Likewise, the desired pressure of the low-pressure system is usually regulated and specified variably depending on the vapor pressure curve of the worst-case fuel and the adaptation values determined.

The actual pressure detected using a low-pressure sensor is compared to the desired pressure and processed in an engine control unit to form a regulator response, wherein simultaneously an adapted adaptation value for the desired pressure is determined and adjusted. A characteristic map having values for the required delivery capacity of the low-pressure pump, which is usually designed as an electric fuel pump, is addressed in the engine control unit by means of the regulator response of the low-pressure regulation, desired pressure, adaptation value and the current fuel mass flow, and a value for the delivery capacity of the pump is determined and outputted.

The desired pressure usually assumes its highest values during hot start and cold start. A formation of vapor bubbles must be prevented during hot start since the high-pressure pump can no longer generate high pressure upon the formation of vapor bubbles. During cold start, the injection valves have to inject a large quantity of fuel into the combustion chamber when the high-pressure pump is not yet active.

However, the delivery capacity of the low-pressure pump reduces with the increasing preliminary pressure, so that at definite operating points and at a high desired pressure, the low-pressure pump is loaded excessively and is pushed to its delivery limits under certain circumstances.

In order to prevent the formation of vapor bubbles in the internal combustion engine on the one hand, while on the other hand ensuring the supply of fuel to the internal combustion in all operating states, DE 199 51 410 A1 suggests the adjustment of the lowest possible preliminary pressure that would reliably avoid any fuel vaporization. For this purpose, the current temperature of the fuel in the high-pressure pump is determined, and the low-pressure pump is controlled or regulated in such a way depending on the determined temperature that the low-pressure pump generates the determined preliminary pressure.

However, in addition to the temperature, the quality of the fuel also has a decisive influence on the formation of vapor bubbles since different fuels vaporize at different temperatures. In order to ensure a secure mode of operation of the internal combustion engine, the preliminary pressure is usually adjusted for the worst-case scenario with a large tolerance control. An optimum adjustment of the preliminary pressure is thus possible, if at all, using additional measures, such as for example, an additional recognition of a refueling operation. Furthermore, those system characteristics of the pressure systems that either cannot be compensated using the known pressure regulations or can be compensated only using further increased tolerances, change during the service life of the internal combustion engine. This likewise leads to an increased pressure level in the fuel supply system and thus to an unnecessarily high power consumption of the low-pressure pump.

SUMMARY

According to an embodiment, a simple, precise and secure adjustment of the preliminary pressure, which is generated by a low-pressure pump, for delivering fuel to an internal combustion engine can be achieved by a method for supplying fuel to an internal combustion engine, comprising the steps of delivering fuel by a low-pressure pump and a high-pressure pump to the internal combustion engine, wherein the low-pressure pump provides a delivery volume of fuel for the high-pressure pump and generates a preliminary pressure, which is applied to the high-pressure pump and the high-pressure pump provides the delivery volume with an injection pressure into an injection system of the internal combustion engine; adjusting the preliminary pressure to a variable desired preliminary pressure that is determined using the vapor pressure curve of a fuel, regulating the injection pressure using a high-pressure regulator, and correcting a control value of the low-pressure pump, which control value corresponds to the desired preliminary pressure, using an adaptation value, determining the adaptation value in an adaptation mode, in which the preliminary pressure is changed until vapor bubbles are formed in front of the high-pressure pump, the formation of vapor bubbles is detected by means of the change in the regulator response of the high-pressure regulator, and upon the detection of vapor bubbles, current process parameters are determined, from which the adaptation value is derived, wherein a desired preliminary pressure is adjusted, which is higher than the vapor pressure of the fuel.

According to another embodiment, a device for supplying fuel to an internal combustion engine, comprises a regulated high-pressure system comprising at least: one injection system for injecting fuel into the internal combustion engine, a high-pressure pump for delivering fuel from a low-pressure system into the injection system, and a high-pressure regulator for regulating the injection pressure in the injection system; and a controlled low-pressure system comprising at least: a low-pressure pump for delivering fuel from a tank into the high-pressure system, and a control unit for adjusting a variable desired preliminary pressure in the low-pressure system, which variable desired preliminary pressure is specified by means of the vapor pressure curve of the fuel, with an adaptation unit for generating an adaptation value in an adaptation mode for correcting the specified desired preliminary pressure, wherein the adaptation unit comprises at least: a unit for activating the adaptation mode, in which a preliminary pressure in the low-pressure system is changed, means for detecting the change in a regulator response of the high-pressure regulator in the adaptation mode upon the formation of vapor bubbles in the low-pressure system, means for detecting process parameters, and a unit for deriving the adaptation value from the process parameters detected.

BRIEF DESCRIPTION OF THE DRAWINGS

The invention will be further explained below in more detail based on exemplary embodiments and with reference to the drawings in which.

DETAILED DESCRIPTION

Figure 1:
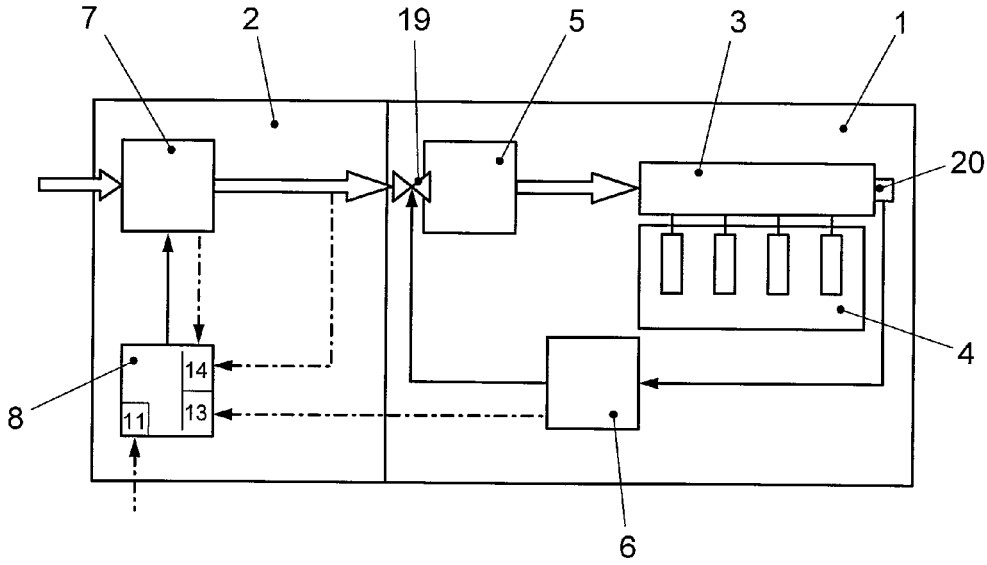
FIG. 1 is a schematic representation of the fuel supply system according to Examples A and B

The method according to an embodiment for supplying fuel to internal combustion engines, in which method a low-pressure pump and a high-pressure pump deliver the fuel to the internal combustion engine, wherein the low-pressure pump provides a delivery volume of fuel for the high-pressure pump and generates a preliminary pressure, which is applied to the high-pressure pump, and the high-pressure pump provides the delivery volume with an injection pressure into an injection system of the internal combustion engine and in which method the preliminary pressure is adjusted to a variable desired preliminary pressure, which is determined using the vapor pressure curve of a fuel, the injection pressure is regulated using a high-pressure regulator and a control value of the low-pressure pump, which control value corresponds to the desired preliminary pressure, is corrected using an adaptation value, said method being characterized in that the adaptation value is determined in an adaptation mode of the fuel supply, in which adaptation mode the preliminary pressure is changed until vapor bubbles are formed in front of the high-pressure pump, the formation of vapor bubbles is detected by means of the change in the response of the high-pressure regulator, and upon the detection of vapor bubbles, current process parameters, preferably performance characteristics of the low-pressure pump and the temperature of the fuel are determined, from which the adaptation value is derived. The desired preliminary pressure adjusted using the adaptation value is increasingly higher than the vapor pressure of the fuel. In the adaptation mode, the vapor bubbles are produced in such a way that the complete functioning of the engine in every phase is ensured. In order to ensure this, the state of the formation of vapor bubbles exists preferably only for a very brief period of time or only to some extent.

The device according to an embodiment for supplying fuel to an internal combustion engine comprises at least one regulated high-pressure system and one controlled low-pressure system. The regulated high-pressure system comprises at least one injection system for injecting fuel into the internal combustion engine, a high-pressure pump for delivering fuel from the low-pressure pump into the injection system and a high-pressure regulator for regulating the injection pressure in the injection system. The controlled low-pressure system comprises at least one low-pressure pump for delivering fuel from a tank into the high-pressure system, a control unit for adjusting a variable desired preliminary pressure, which is specified using a vapor pressure curve of a fuel, in the low-pressure system having an adaptation unit for generating an adaptation value in an adaptation mode for correcting the specified desired preliminary pressure. The adaptation unit comprises at least one unit for activating the adaptation mode, in which a preliminary pressure in the low-pressure system is changed, means for detecting the change in a regulator response of the high-pressure regulator in the adaptation mode upon the formation of vapor bubbles in the low-pressure system, means for detecting process parameters and a unit for deriving the adaptation value from the process parameters detected.

Both diesel engines and spark-ignited engines come into consideration as internal combustion engines, which are supplied with fuel using the method according to an embodiment and the device according to yet another embodiment.

According to an embodiment, a conclusion is drawn in an adaptation mode with the help of the high-pressure regulator about the outgassing behavior of the fuel and the state of the low-pressure pump. Once vapor bubbles are formed in the adaptation mode in front of the high-pressure pump, the volumetric efficiency of the high-pressure pump deteriorates. The high-pressure regulator constantly shows a clear regulator response to the deteriorating volumetric efficiency. This regulator response is used in order to determine an adaptation value for correcting the desired preliminary pressure to be adjusted by the low-pressure pump.

The preliminary pressure can preferably be changed in the adaptation mode by impressing an oscillation upon that control value of the low-pressure pump that corresponds to the desired preliminary pressure so that an oscillation is impressed upon the delivery capacity of the low-pressure pump. During this pressure oscillation, the monitoring of the high-pressure regulator is active. If bubbles form in front of the high-pressure pump in the oscillation valley, this is detected by means of a change in the regulator response. If there occurs no change in the regulator value, the desired preliminary pressure is lowered to a defined value and the adaptation mode is continued until vapor bubbles are detected. The desired preliminary pressure is lowered particularly by lowering an existing adaptation initial value. In order to ensure that the lowered adaptation value does not lower the desired preliminary pressure steadily until the formation of vapor bubbles, the lowered adaptation initial value, which is determined upon the formation of vapor bubbles, can preferably be increased by a defined value, and the adaptation value is thus derived from the lowered adaptation initial value.

The impressed oscillation adjusts the preliminary pressure in the adaptation mode in such a way that vapor bubbles can always be formed only temporarily in the fuel, thereby preventing a short-duration pressure drop in the high-pressure system.

The high-pressure regulator preferably may regulate the injection pressure in the injection system by means of a quantity-regulated high-pressure pump. The injection system may preferably be formed as a common rail system. The pressure generation and the fuel injection are separate or decoupled from each other in the common rail system. The high-pressure pump continuously generates a definite high pressure, which is permanently available in the injection system in the form of injection pressure. The high pressure is regulated and stored in the common rail of the injection system and provided by way of short injection lines to the injectors for injecting the fuel into the cylinders of the engine. A high pressure is usually generated in the two-digit Mpa range.

According to an embodiment, in which the fuel supply takes place in a non-return manner, i.e. without fuel return, for delivering the fuel from the high-pressure pump, which is designed particularly as a reciprocating piston pump, a volume of fuel is delivered in the downward stroke of the piston into the displacement of the pump by way of an open quantity-control valve, which is disposed between the high-pressure pump and the low-pressure pump. When the piston performs an upward stroke and the quantity-control valve is closed, the fuel is compressed and delivered into the injection system. The pressure can be detected preferably using a high-pressure sensor disposed in the injection system. The desired injection pressure is adjusted by means of the high-pressure regulation, in which the quantity-control valve is used as an actuator.

For determining the adaptation value, the preliminary pressure is changed, particularly by gradually lowering the delivery capacity of the low-pressure pump, which may be preferably designed as an electric fuel pump until vapor bubbles are detected in the system. The formation of vapor bubbles is associated with the specific vapor pressure, i.e. the specific pressure of the saturated vapor of the fuel. The specific vapor pressure is composed of the sum of the partial pressures of its individual components and is dependent on the temperature. If the preliminary pressure in the low-pressure system is lower than the specific vapor pressure of the fuel, then vapor bubbles are formed. In the adaptation mode, the vapor pressure limit of the fuel is approximated purposefully until the volumetric efficiency of the high-pressure pump deteriorates significantly and a defined deviation of the regulator response is achieved.

If portions of the fuel filled into the displacement or compression chamber of the high-pressure pump are composed of vapor bubbles, then for example, an additional compression volume must be provided for compressing the vapor bubbles in order to deliver the same quantity of fuel. The change in this regulator response can be used preferably for detecting vapor bubbles.

According to an embodiment of the method, the preliminary pressure is lowered gradually in the adaptation mode with or without the impression of an oscillation until a specified maximum permissible change in the regulator response or a minimum permissible preliminary pressure is achieved. Preferably, at the start of the adaptation mode, the desired preliminary pressure can be specified from the vapor pressure curve of the worst-case fuel. The vapor pressure curve shows the temperature dependency of the vapor pressure and is illustrated in the pressure-temperature graph as a limiting curve between the two phases liquid and gaseous. The vapor pressure curve is dependent on the type of fuel. The worst-case fuel is the fuel having the highest volatility, for example, freshly filled winter fuel having a vapor pressure of 12 to 14 PSI.

When the specified maximum permissible change in the regulator response is achieved, the current value of the delivery capacity of the low-pressure pump and the current value of the temperature of the fuel is detected in an advantageous embodiment using suitable means and the adaptation value is determined from these values in the unit for deriving the adaptation value. The adaptation value can be determined preferably using characteristic maps having characteristic curves, which specify the associated adaptation values for definite delivery capacities and temperatures.

When the specified maximum permissible change in the regulator response is achieved, the current value of the lowered preliminary pressure is detected in another embodiment and increased by a defined value and the current adaptation value is derived therefrom.

The adaptation value can be preferably stored and used for calculating the required delivery capacity of the low-pressure pump.

The determined adaptation value represents both the tolerance position of the low-pressure pump and the current outgassing activity of the fuel. Changes with respect to the outgassing activity and the pump properties are thus taken into account and the low-pressure pump can work with optimum low power consumption when the desired preliminary pressure, which is corrected using the determined adaptation value, is adjusted.

The adaptation value is not determined constantly during the fuel supply. Instead, it is determined in an adaptation mode, which preferably can be activated at regular intervals or using defined boundary conditions by means of a unit for activating the adaptation mode, for example, when the engine has been operated for a defined period of time, or has been refueled, or is restarted after a longer downtime. The adaptation mode can be preferably started only when stable operating conditions or system conditions are present, particularly when the fuel mass flow and the temperature of the fuel in front of the high-pressure pump are stable. After the adaptation value is determined, the adaptation mode is exited again, and the fuel supply goes on in normal operation, wherein the corrected desired preliminary pressure curve is adjusted in the low-pressure system and the injection pressure in the high-pressure system is regulated. A reasonable frequency of the adaptation mode ensures that changes with respect to the fuel quality and properties of the low-pressure pump are being taken into account on time.

EXAMPLE A

Adaptation Mode Without an Impression of Oscillation

FIG. 1 shows a schematic structure of an fuel supply system according to an embodiment by way of example comprising a regulated non-return high-pressure system 1 and a controlled low-pressure system 2 for supplying fuel to a direct-injection internal combustion engine 4 from a tank (not shown).

The low-pressure pump 7, designed as an electric fuel pump, delivers the fuel from a tank to the high-pressure pump 5. The fuel delivered by the low-pressure pump 7 is applied to the high-pressure pump 5 with a preliminary pressure.

The high-pressure system 1 is a regulated system. The high-pressure pump 5, designed as a quantity-regulated reciprocating piston pump having a quantity-control valve 19, supplies the injection system 3 with fuel. The injection system 3 is designed as a common rail system. Consequently, the high-pressure pump 5 generates a permanent high injection pressure in the injection system 3. The high-pressure regulator 6 regulates the injection pressure, wherein the actual injection pressure is detected using a high-pressure sensor 20 disposed in the injection system 3 and is processed in the high-pressure regulator 6 to form a control signal for the quantity-control valve 19.

For filling the displacement or compression chamber of the high-pressure pump 5, the piston of the high-pressure pump performs a downward stroke, wherein the quantity-control valve 19 is open and the fuel is delivered from the low-pressure system 2 into the high-pressure system 1. The volumetric efficiency of the high-pressure pump depends on the preliminary pressure and the quality of the fuel. During the upward stroke of the piston of the high-pressure pump 5, the fuel is compressed only when the quantity-control valve 19 is closed. The period of time during which the quantity-control valve 19 stays closed determines the quantity of fuel delivered into the injection system 3.

The low-pressure system 2 is a controlled system. The desired preliminary pressure of the controlled low-pressure system 2 is specified variably by the control unit 8 using the vapor pressure curve 9 of the worst-case fuel, for example, winter fuel having 12 to 14 PSI, and an adaptation value determined in an adaptation mode. The adaptation value represents both the current tolerance position of the low-pressure pump 7 and the current fuel quality.

Figure 2:
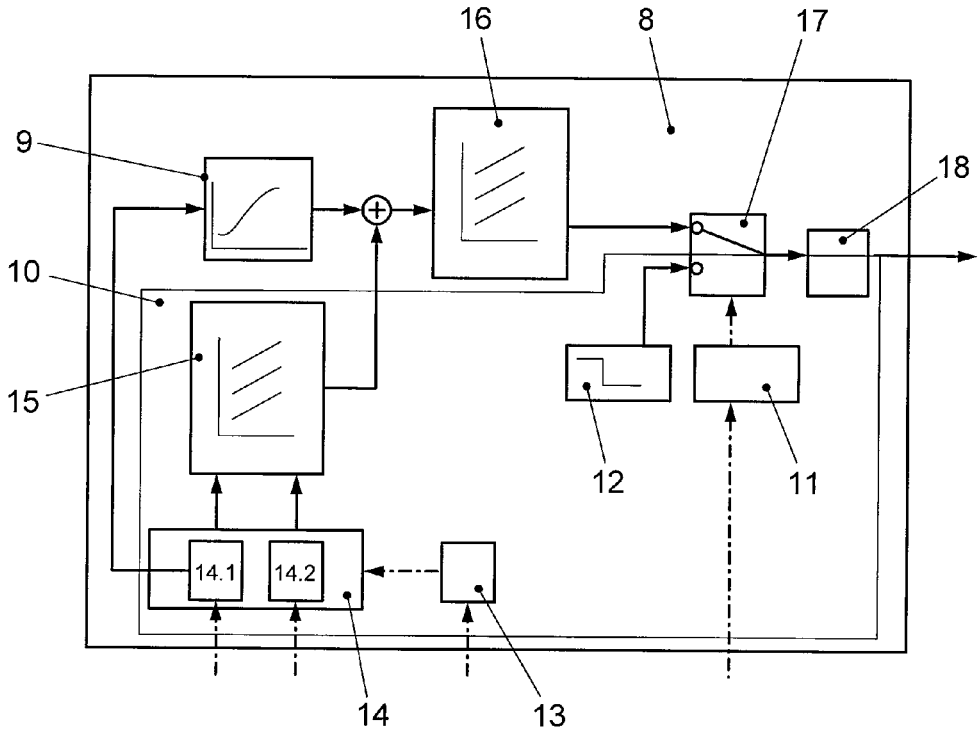
FIG. 2 is a schematic representation of the control according to an embodiment of the low-pressure pump using an adaptation mode shown in FIG. 4 (Example A)

FIG. 2 shows the control of the low-pressure system 2. A pre-control characteristic map 16 is addressed from the sum of the pressure value resulting from the vapor pressure curve 9 and the adaptation value and also the current fuel flow rate. The pre-control characteristic map 16 contains values for the required delivery capacity of the low-pressure pump 7 depending on the pressure and fuel flow rate. The value for the required delivery capacity is corrected by means of the correction 18 of the over-voltage, start overshoot and the push mode fuel cutoff and outputted to the power output stage of the low-pressure pump 7.

Figure 4:
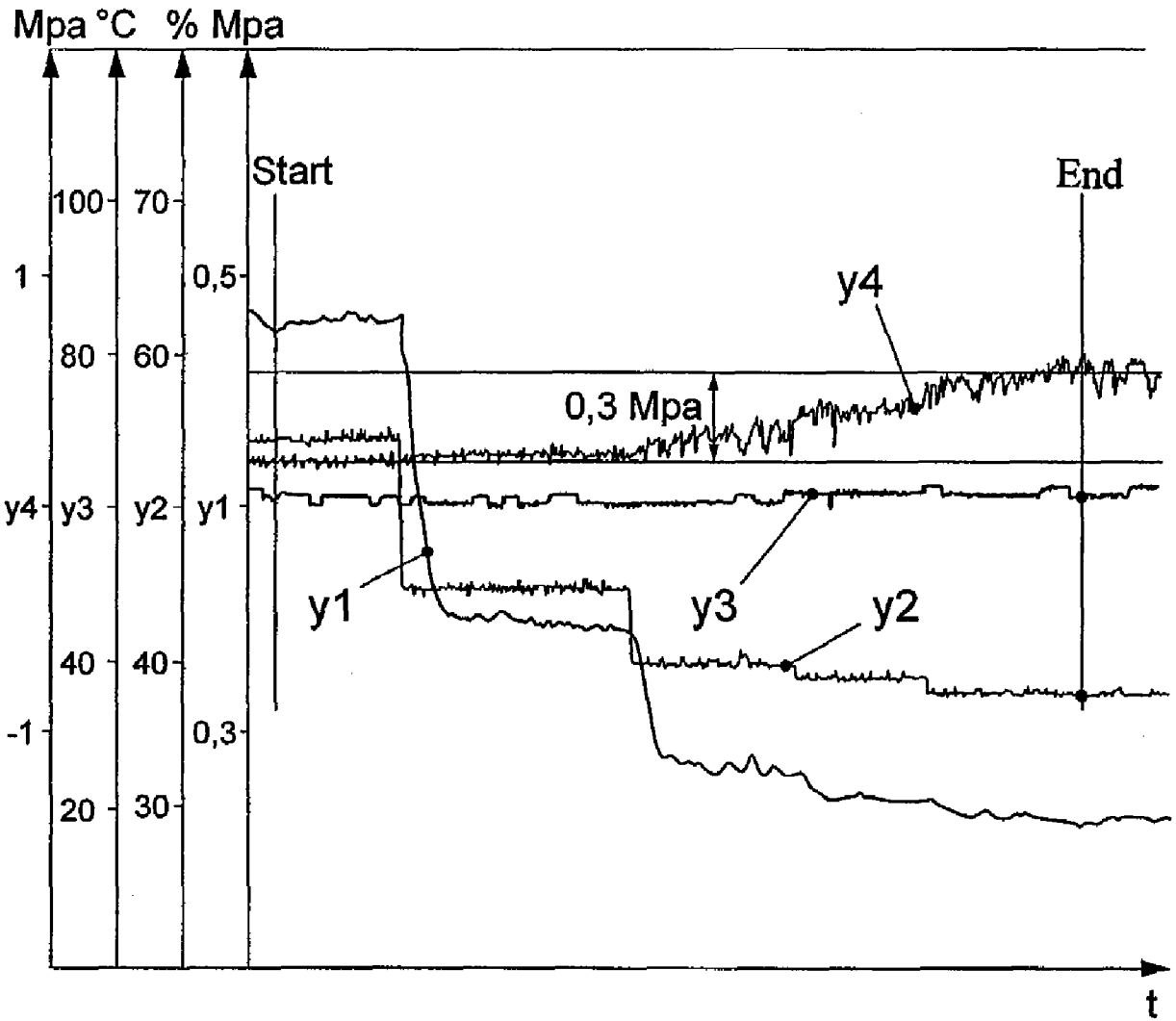
FIG. 4 is a schematic representation of the adaptation mode without an impression of oscillation (Example A)

The adaptation unit 10 determines the adaptation value in an adaptation mode that is shown schematically in FIG. 4. The adaptation value is not determined continuously; instead it is learned actively in individual, discrete events. An event for learning the adaptation value takes place when previously defined boundary conditions are met and a requirement for learning the adaptation value is recognized in the unit 11 for activating the adaptation mode 12. A requirement for learning the adaptation value is recognized when the internal combustion engine 4 is restarted after a downtime and the tank fill level has experienced a significant change or when the internal combustion engine 4 has been operated for a defined period of time. Defined boundary conditions likewise include stable operating conditions of the fuel supply system, which are recognized at a defined level, for example, using steady-state process parameters such as the temperature of the fuel and fuel mass flow.

If the unit 11 for activating the adaptation mode recognizes an event for learning the adaptation value, a switch 17 is used for switching over to and starting the adaptation mode 12. The adaptation mode 12 lowers the required delivery capacity (FIG. 4, curve y2) of the low-pressure pump 7 gradually, wherein the preliminary pressure (FIG. 4, curve y1) drops down in the low-pressure system until vapor bubbles are formed in front of the high-pressure pump 5. A definite change in the response (FIG. 4, curve y4) of the high-pressure regulator 6 is used as a criterion for detecting the formation of vapor bubbles. If portions of the fuel delivered into the high-pressure pump 5 consist of vapor bubbles, the quantity-control valve 19 must remain closed for a longer period of time in order to deliver the same quantity of fuel into the injection system 3. An additional compression volume must be provided for compressing the vapor bubbles, thereby causing the regulator response to increase by a definite pressure value. The change in the regulator response is registered using means 13 for detecting the change in the regulator response, wherein if the regulator response increases by a defined pressure value of 0.3 Mpa by way of example, the detection of the temperature, present at this point in time, of the fuel (FIG. 4, curve y3) in front of the high-pressure pump 5 and the required delivery capacity present at the power output stage of the low-pressure pump 7 are activated. These parameters are determined using appropriate means 14 for detecting process parameters, particularly means 14.2 for detecting the temperature and means 14.1 for detecting performance characteristics of the low-pressure pump 7 and stored in the unit 15 for deriving the adaptation value. The stored values of the current required delivery capacity and temperature of the fuel are read into a characteristic map of the unit 15 for deriving the adaptation value, wherein the characteristic map is used to derive a current adaptation value from the stored values. This characteristic map can be determined beforehand, for example, empirically. Alternatively, an empirically determined formula can also be used instead of the characteristic map.

The active adaptation mode 12 is thereafter exited again. The switch 17 is used for changing over to normal operation, wherein the earliest point in time of the change-over to normal operation is that point in time at which the vapor bubbles are detected and the latest point in time of the changeover to normal operation should be the point in time at which the adaptation value is determined, in order to prevent a significant deterioration of the volumetric efficiency of the high-pressure pump 5.

During normal operation, the preliminary pressure of the low-pressure system 2 is then controlled using a corrected desired preliminary pressure, which results from the sum of the pressure value resulting from the vapor pressure curve 9 depending on the temperature of the fuel in front of the high-pressure pump and the currently determined adaptation value.

EXAMPLE B

Adaptation Mode with an Impression of Oscillation

Similarly to Example A, the fuel supply system in Example B likewise consists of a regulated non-return high-pressure system 1 and a controlled low-pressure system 2, as shown in FIG. 1. The mode of operation differs from that of Example A in terms of the adaptation mode, which is formed such that an oscillation is impressed upon the required delivery capacity of the low-pressure pump 7.

The high-pressure system 1 is a regulated system, as mentioned already in Example A.

Figure 3:
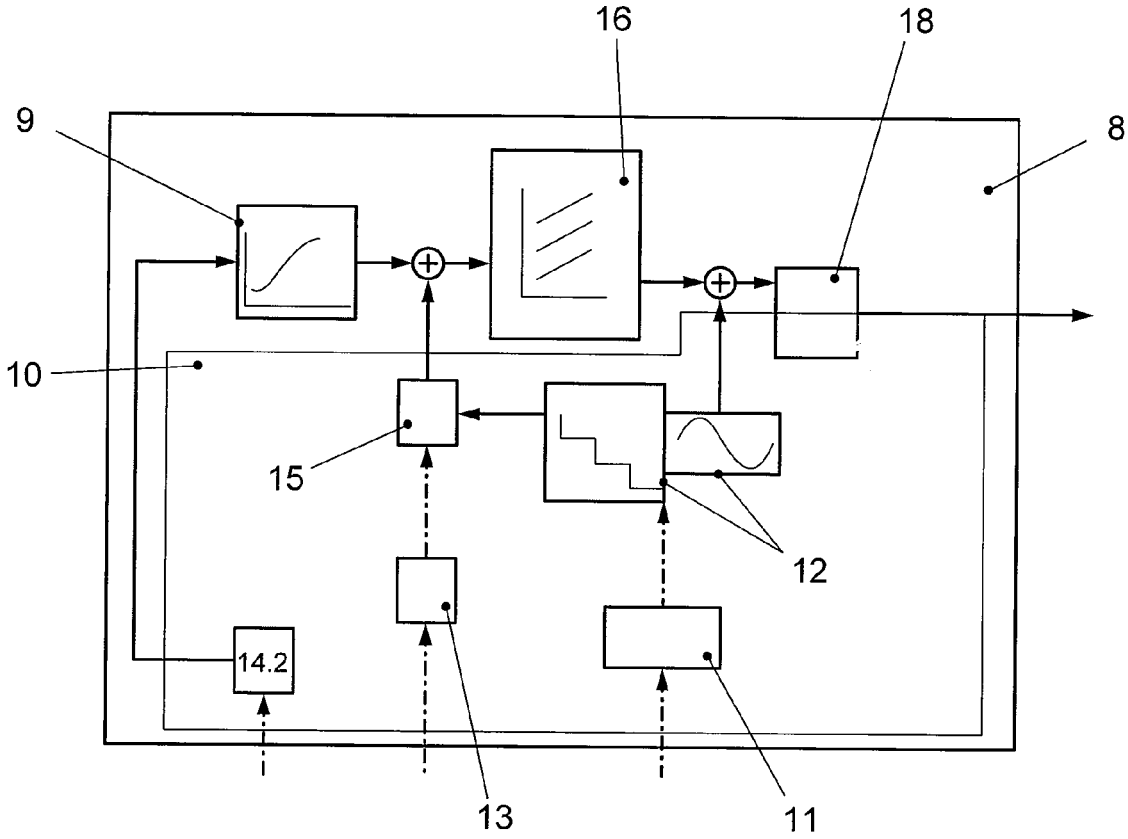
FIG. 3 is a schematic representation of the control according to an embodiment of the low-pressure pump using an adaptation mode shown in FIG. 5 (Example B)

The low-pressure system 2 is a controlled system and is shown schematically in FIG. 3. The desired preliminary pressure of the controlled low-pressure system 2 is specified variably by means of the vapor pressure curve 9 by detecting the temperature of the fuel in front of the high-pressure pump 5 using means 14.2 for detecting the temperature and by reading said temperature into a characteristic map, which is specified using the vapor pressure curve 9 of the worst-case fuel, for example, winter fuel having 12 to 14 PSI and by deriving a pressure value from the vapor pressure curve and adding an adaptation value thereto. The adaptation unit 10 specifies the adaptation initial value and/or the adaptation value determined in the adaptation mode. The adaptation value determined in the adaptation mode represents both the actual tolerance position of the low-pressure pump 7 and the current fuel quality.

A pre-control characteristic map 16 is addressed using the corrected desired preliminary pressure. The pre-control characteristic map 16 contains values for the required delivery capacity of the low-pressure pump 7 depending on the pressure. The value for the required delivery capacity is corrected by means of the over-voltage, start overshoot and the correction 18 of the push mode fuel cutoff and outputted to the power output stage of the low-pressure pump 7.

Figure 5:
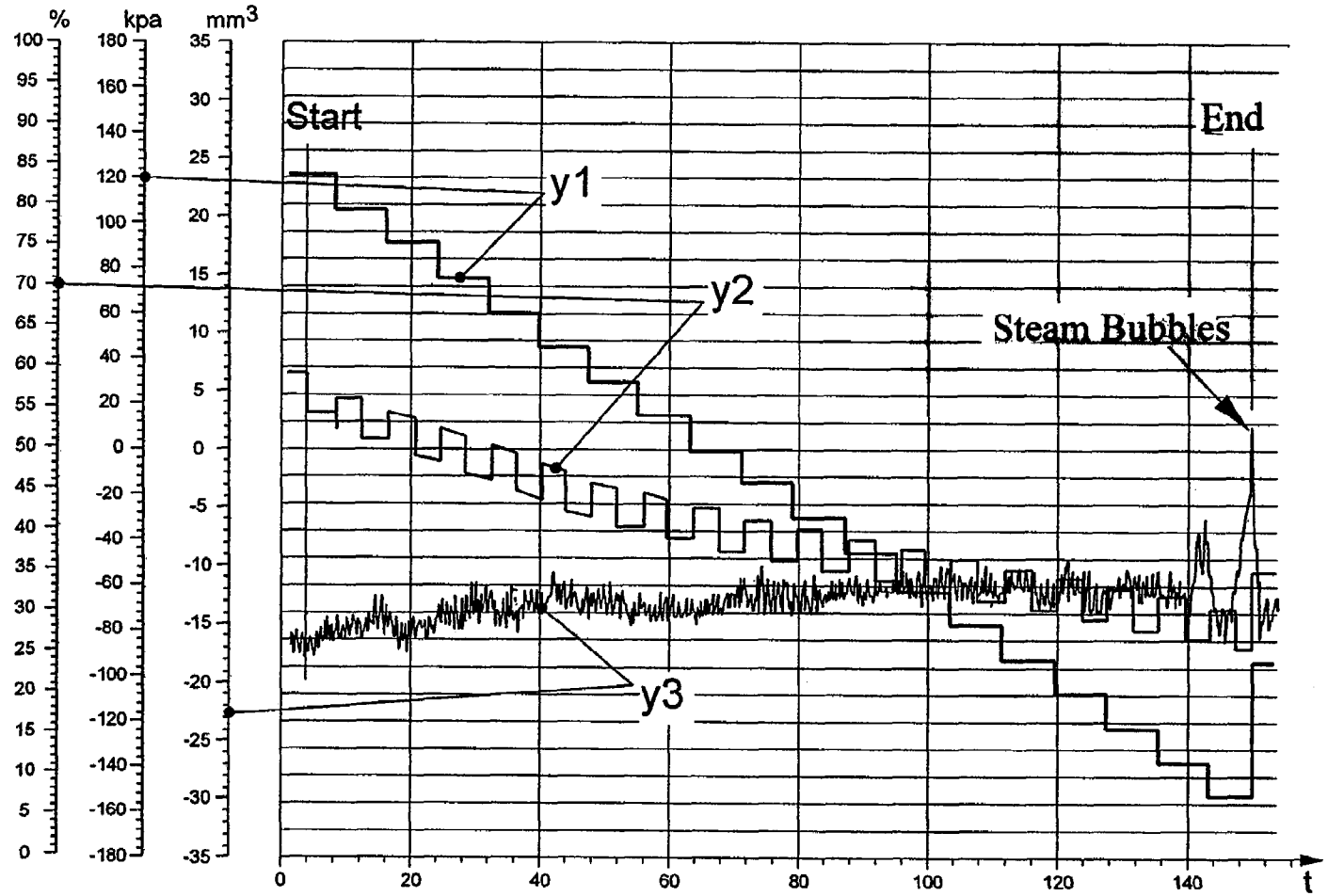
FIG. 5 is a schematic representation of the adaptation mode with an impression of oscillation (Example B)

The adaptation unit 10 determines the adaptation value in an adaptation mode that is shown schematically in FIG. 5. The adaptation value is not determined continuously; instead it is learned actively in individual, discrete events, as mentioned in Example A.

If the unit 11 for activating the adaptation mode recognizes an event for learning the adaptation value, the adaptation mode 12 is started, wherein the present adaptation initial value remains unchanged in a first step and an oscillation is impressed upon the required delivery capacity (FIG. 5, curve y2) of the low-pressure pump 7, wherein the preliminary pressure in the low-pressure system is changed accordingly. If no vapor bubbles are detected, the specified adaptation initial value (FIG. 5, curve y1) is lowered gradually until vapor bubbles are formed in front of the high-pressure pump 5. A definite change in the response (FIG. 5, curve y3) of the high-pressure regulator 6 is used as a criterion for detecting the formation of vapor bubbles. This change in the regulator response is registered using means 13 for detecting the change in the regulator response, wherein if the regulator response increases by a defined volume value, then the lowered adaptation initial value present at this point in time is detected. This process parameter is stored in the unit 15 for deriving the adaptation value and increased by a safety value and the adaptation value is thus derived.

The active adaptation mode 12 is thereafter exited again. During normal operation, the preliminary pressure of the low-pressure system 2 is then controlled using a corrected desired preliminary pressure, which results from the sum of the pressure value resulting from the vapor pressure curve 9 and the currently determined adaptation value.

LIST OF REFERENCE NUMERALS

| | |
|---|---|
| 1 | High-pressure system |
| 2 | Low-pressure system |
| 3 | Injection system |
| 4 | Internal combustion engine |
| 5 | High-pressure pump |
| 6 | High-pressure regulator |
| 7 | Low-pressure pump |
| 8 | Control unit |
| 9 | Vapor pressure curve |
| 10 | Adaptation unit |

-continued

LIST OF REFERENCE NUMERALS

| | |
|---|---|
| 11 | Unit for activating the adaptation mode |
| 12 | Adaptation mode |
| 13 | Means for detecting a change in the regulator response |
| 14 | Means for detecting process parameters |
| 14.1 | Means for detecting performance characteristics |
| 14.2 | Means for detecting the temperature |
| 15 | Unit for deriving the adaptation value |
| 16 | Pre-control characteristic map |
| 17 | Switch |
| 18 | Correction of the push mode fuel cutoff |
| 19 | Quantity control valve |
| 20 | High-pressure sensor |

The invention claimed is:

1. A method for supplying fuel to an internal combustion engine, comprising the steps of:

delivering fuel by a low-pressure pump and a high-pressure pump to the internal combustion engine, wherein the low-pressure pump provides a delivery volume of fuel for the high-pressure pump and generates a preliminary pressure, which is applied to the high-pressure pump and the high-pressure pump provides the delivery volume with an injection pressure into an injection system of the internal combustion engine;

adjusting the preliminary pressure to a variable desired preliminary pressure that is determined using the vapor pressure curve of a fuel, regulating the injection pressure using a high-pressure regulator, and correcting a control value of the low-pressure pump, which control value corresponds to the desired preliminary pressure, using an adaptation value, determining the adaptation value in an adaptation mode, in which the preliminary pressure is changed until vapor bubbles are formed in front of the high-pressure pump, the formation of vapor bubbles is detected by means of the change in the regulator response of the high-pressure regulator, and upon the detection of vapor bubbles, current process parameters are determined, from which the adaptation value is derived, wherein a desired preliminary pressure is adjusted, which is higher than the vapor pressure of the fuel, and wherein the preliminary pressure is changed in the adaptation mode by impressing an oscillation upon that control value of the low-pressure pump that corresponds to the desired preliminary pressure.

2. The method according to claim 1, wherein the preliminary pressure is lowered gradually in the adaptation mode.

3. The method according to claim 1, wherein the adaptation mode is implemented at predetermined intervals in stable operating conditions.

4. The method according to claim 1, wherein the adaptation mode is implemented after restarting the motor in stable operating conditions.

5. The method according to claim 1, wherein the desired preliminary pressure is specified from the vapor pressure curve of the worst-case fuel.

6. The method according to claim 1, wherein the preliminary pressure is lowered in the adaptation mode until a specified maximum permissible change in the regulator response is achieved.

7. The method according to claim 1, wherein the preliminary pressure is lowered by lowering an adaptation initial value, and the lowered adaptation initial value is determined as the current process parameter from which the adaptation value is derived.

8. The method according to claim 1, wherein performance characteristics of the low-pressure pump are determined as current process parameters from which the adaptation value is derived.

9. The method according to claim 1, wherein the temperature of the fuel is determined as the current process parameter from which the adaptation value is derived.

10. The method according to claim 8, wherein when a specified maximum permissible change in the regulator response is achieved, the current value of a delivery capacity of the low-pressure pump and a current value of the temperature of the fuel are detected and the adaptation value is derived from these values.

11. The method according to claim 8, wherein the adaptation value is derived from at least one characteristic map, which assigns adaptation values to process parameters.

12. The method according to claim 1, wherein the adaptation mode is exited after the adaptation value is determined.

13. The method according to claim 1, wherein the formation of vapor bubbles is detected by means of that compression volume of the high-pressure pump that results in the form of a regulator response and is to be applied additionally for delivering the same quantity of fuel.

14. A device for supplying fuel to an internal combustion engine, comprising:

a regulated high-pressure system comprising at least:

one injection system for injecting fuel into the internal combustion engine, a high-pressure pump for delivering fuel from a low-pressure system into the injection system, and a high-pressure regulator for regulating the injection pressure in the injection system and a controlled low-pressure system comprising at least:

a low-pressure pump for delivering fuel from a tank into the high-pressure system, and a control unit for adjusting a variable desired preliminary pressure in the low-pressure system, which variable desired preliminary pressure is specified by means of the vapor pressure curve of the fuel, with an adaptation unit for generating an adaptation value in an adaptation mode for correcting the specified desired preliminary pressure, wherein the adaptation unit comprises at least:

a unit for activating the adaptation mode, in which a preliminary pressure in the low-pressure system is changed, by impressing an oscillation upon a control value of the low-pressure pump that corresponds to the desired preliminary pressure, means for detecting the change in a regulator response of the high-pressure regulator in the adaptation mode upon the formation of vapor bubbles in the low-pressure system, means for detecting process parameters, and a unit for deriving the adaptation value from the process parameters detected.

15. The device according to claim 14, wherein the high-pressure regulator for regulating the injection pressure is connected to a quantity control valve disposed between the low-pressure pump and the high-pressure pump, and to a high-pressure sensor disposed in the injection system.

16. The device according to claim 14, wherein the high-pressure pump is a reciprocating piston pump.

17. The device according to claim 14, wherein the means for detecting the change in the regulator response are means for detecting a compression volume of the high-pressure pump that is to be applied additionally for delivering the same quantity of fuel when bubbles are formed.

18. The device according to claim 14, wherein the low-pressure pump is an electric fuel pump.

19. The device according to claim 14, wherein the means for detecting process parameters comprise means for detecting performance characteristics of the low-pressure pump.

20. The device according to claim 14, wherein the means for detecting process parameters comprise means for detecting the temperature of the fuel.

21. The device according to claim 14, wherein the unit for deriving the adaptation value comprises at least one characteristic map, which assigns adaptation values to process parameters.

22. The device according to claim 14, wherein the injection system is a common rail system.

* * * * *